United States Patent [19]

Cornelison

[11] Patent Number: 5,009,220

[45] Date of Patent: Apr. 23, 1991

[54] SAFETY ENCLOSURE FOR COAL, GAS OR WOOD-BURNING FIREPLACE

[75] Inventor: Peter B. Cornelison, Hiram, Ohio

[73] Assignee: Condar, Inc., Garrettsville, Ohio

[21] Appl. No.: 440,105

[22] Filed: Nov. 22, 1989

[51] Int. Cl.[5] ..... F24B 1/188

[52] U.S. Cl. ..... 126/523; 126/529; 126/500; 237/79

[58] Field of Search ..... 126/523, 528, 500, 110 R, 126/529; 237/79

[56] References Cited

U.S. PATENT DOCUMENTS

| | | | |
|---|---|---|---|
| 2,830,574 | 4/1958 | Shozer | 126/201 X |
| 4,607,611 | 3/1986 | Rice et al. | 126/500 |
| 4,700,687 | 10/1987 | Bailey et al. | 126/500 |

*Primary Examiner*—Larry Jones

*Attorney, Agent, or Firm*—Robert A. Sturges

[57] ABSTRACT

A reduced clearance system, or heat shield, for a coal, gas or wood burning fireplace having a cast iron surround, a hood and a grate, said heat shield including a sheet metal box, preferably a double wall sheet metal box with insulation between the wall members, having a base, three vertical sides, and a stepped top. Each of the sides has secured externally thereto a generally horizontal spacer bar. The front is open and receives the fireplace, the latter being secured to the shield by a clamping bar mounted on the front of the lower top step and side clamps. Each of the top closures has spacer bars attached thereto. The uppermost top portion has an aperture adapted to receive and retain a chimney system. Embodiments of this invention are safety approved.

12 Claims, 4 Drawing Sheets

SAFETY ENCLOSURE FOR COAL, GAS OR WOOD-BURNING FIREPLACE

This invention relates, as indicated, to a safety enclosure for the back of a coal, gas or wood-burning fireplace insert. More particularly, this invention relates to a reduced clearance system (RCS) which assures a safe, albeit minimum, clearance between a hot fireplace and adjacent building structure, e.g., wood framing. The devices hereof are especially adapted for use within a wood or steel frame building.

BACKGROUND OF THE INVENTION

Wood, coal or gas burning decorative fireplaces are growing in popularity. A useful decorative fireplace is composed of a cast iron or steel surround, a recessed cast iron or steel back, means for directing flue gases, a bottom grate, and in certain embodiments, an ash pan and cover, and a front grate. In some embodiments, sidewalls extending from the back to the surround may be angularly forwardly directed and adapted to accept decorative tiles. These are generally known as antique style fireplace inserts. For safety reasons, this structure cannot be in contact with or in too close proximity to a flammable building structure, e.g., wood framing. Factory built fireplaces are frequently installed after the building has been framed, and eliminates the need for a brick fireplace and masonry chimney.

Various standards have been adopted limiting the proximity of such fireplaces to flammable structural members, e.g., UL 127 Standard for Safety on Factory Built Fireplaces. The present invention provides a means for reducing the required clearance to a minimum and is based on a maximum allowable temperature adjacent the flammable members which is safely below the ignition temperature of flammable building materials, e.g., insulation and wood framing. A suitable maximum temperature is about 170 degrees F. on concealed surfaces. On surfaces that are exposed, the maximum temperature generally allowed is about 190 degrees F. These devices are adapted for interior use with fireplaces inserted in an existing framed wall, a built-out wall, a corner location, or an exterior wall. The present invention also converts a fireplace insert originally intended for installation in a masonry fireplace into a stand alone, factory built fireplace which uses a metal chimney pipe.

BRIEF STATEMENT OF THE INVENTION

Briefly stated, the present invention is a reduced clearance heat shield or cabinet useful with a cast iron or steel fireplace having a surround with a rectangular outer periphery, said heat shield including a sheet metal box at least partially open at the front and having a sheet metal base and sheet metal side walls (preferably dual sheet metal walls with fiberglass insulation between) vertically extending from each of the three shorter sides of the base. One of the sidewalls includes near the base an air inlet aperture. Secured to the outside of each of the side walls at, for example, about the midpoint of the sidewall, is a generally outwardly projecting sheet metal spacer bar desirably of inverted V-shape designed to provide clearance distance to combustible surfaces. The opposing side walls are preferably stepped at the top to provide a recess in the top marginal edge of such walls. A first trapezoidally shaped top member is provided for the higher step and has an aperture adapted to accept a flue member. A second trapezoidally shaped top member is provided for the lower step. A rectangular front member is provided and is adapted to cover the riser portion of the step. For convenience, the two trapezoidally shaped members and the front member are fashioned as a single piece which is conveniently riveted to the top marginal edges of the side walls. The second trapezoidally shaped top member has at least a pair of spaced sheet metal spacer bars extending generally normal to the front member. The front member has generally vertically extending sheet metal spacer bars spaced apart. The spacer bars are all secured to the respective surfaces, as by welding. Means are provided along the top front marginal edge of the second trapezoidally shaped top member for engaging and holding the heat shield to the top marginal edge of the cast iron fireplace surround. Desirably, the metal portions of the heat shield are of high temperature, nonrusting steel, e.g., aluminized steel. In more specific embodiments, the heat shield includes an anchor plate for a metal chimney system, which anchor plate includes a collar adapted to fit into the aperture in the first trapezoidally shaped top member.

BRIEF DESCRIPTION OF THE DRAWINGS

The invention may be better understood by having reference to the annexed drawings showing a preferred embodiment of this invention and wherein.

DETAILED DESCRIPTION OF THE DRAWINGS

As indicated above, the present invention is a heat shield or reduced clearance system (RCS) for a fireplace, and especially a cast iron decorative fireplace which system assures that a minimum clearance is maintained between flammable building components, e.g., wood studs, and the heat source which may be a coal fire, a gas flame or log, or a wood fire. Were the back of the cast iron fireplace not protected as provided hereby, the temperature of adjacent flammable components, even though at a much greater distance from the fireplace, could rise to a dangerous level and possibly cause the house or building to ignite.

Figure 1:
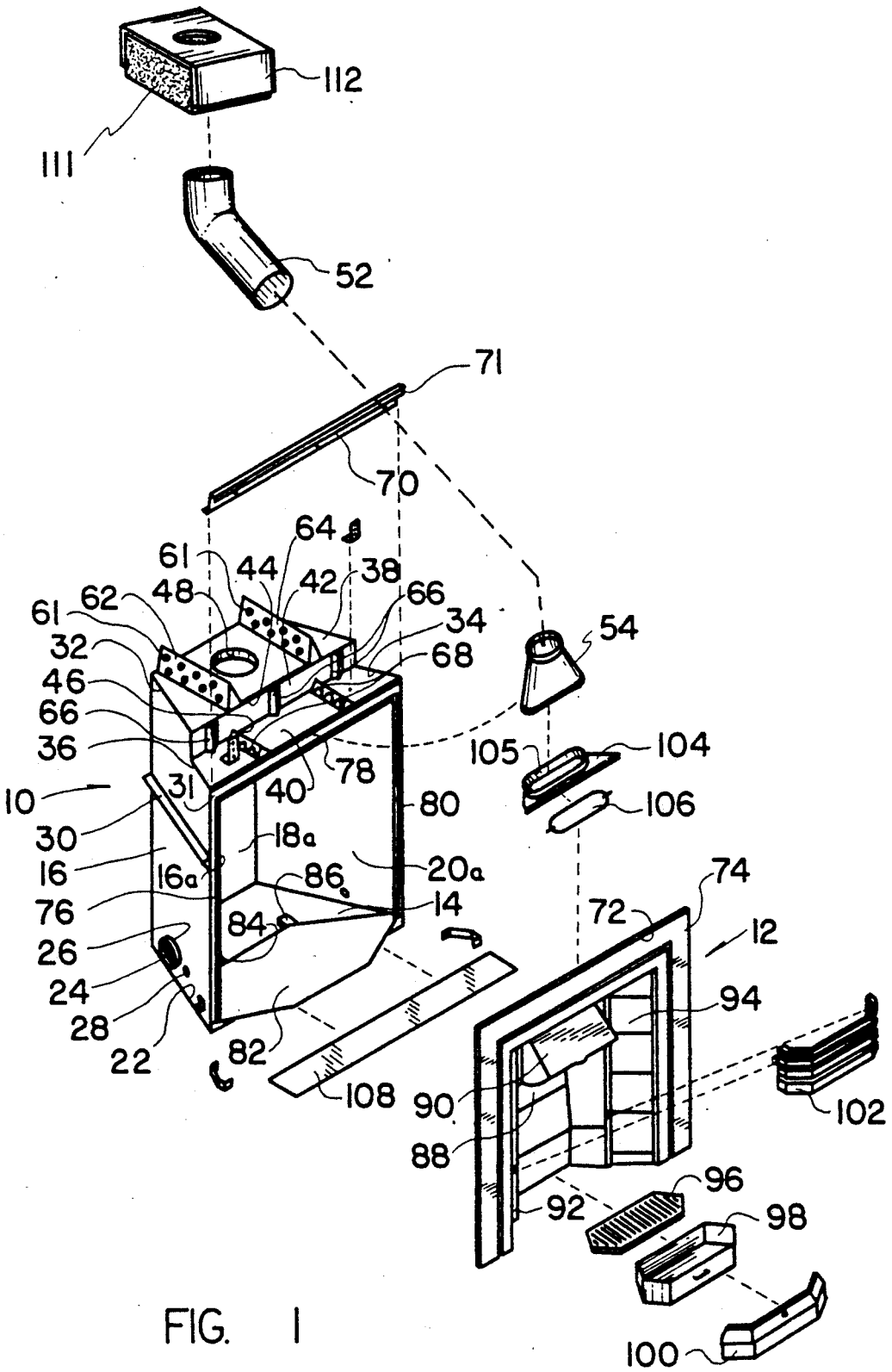
FIG. 1 is an exploded view in perspective showing the heat shield of this invention together with associated parts including a fireplace and fireplace components, a clamping rail and a chimney base pad.

Referring now more particularly to FIG. 1, there is here shown in an exploded, perspective view, a reduced clearance system or heat shield 10 in accordance herewith together with a fireplace assembly 12. The RCS or heat shield 10 comprises a base plate 14 of generally trapezoidal shape. It may be rectangular, but this configuration poses problems for corner installations which are often desired and to which end the trapezoidal configuration is better adapted. Hence, the trapezoidal shape is preferred. The distance between the parallel sides of the base plate 14 is about 17" to 20", e.g., 18.25" exclusive of a 1" spacer bar described below.

Attached to the base plate 14 are three sidewalls 16, 18, and 20. The sidewalls 16, 18, and 20 may be formed from a single sheet of metal, or may be individually fitted and welded together along their vertical seams as indicated above, it is desirable that the side walls be double walls, i.e., having inner and outer sheet metal walls, e.g., 16, 16*a*, 20, 20*a* and 18*a* (FIG. 1) each of 0.030" thick aluminized steel with a 1" thick layer of fiberglass insulation 31 between. The sidewalls 16, 16*a*, 18*a*, 20 and 20*a* are desirably riveted to the base plate 14 along the bottom marginal edge(s). The sidewalls 16, 16*a*, 20 and 20*a* are called lateral and the sidewall 18*a* is referred to as the back. (The back wall 18 is not visible in FIG. 1).

Figure 2:
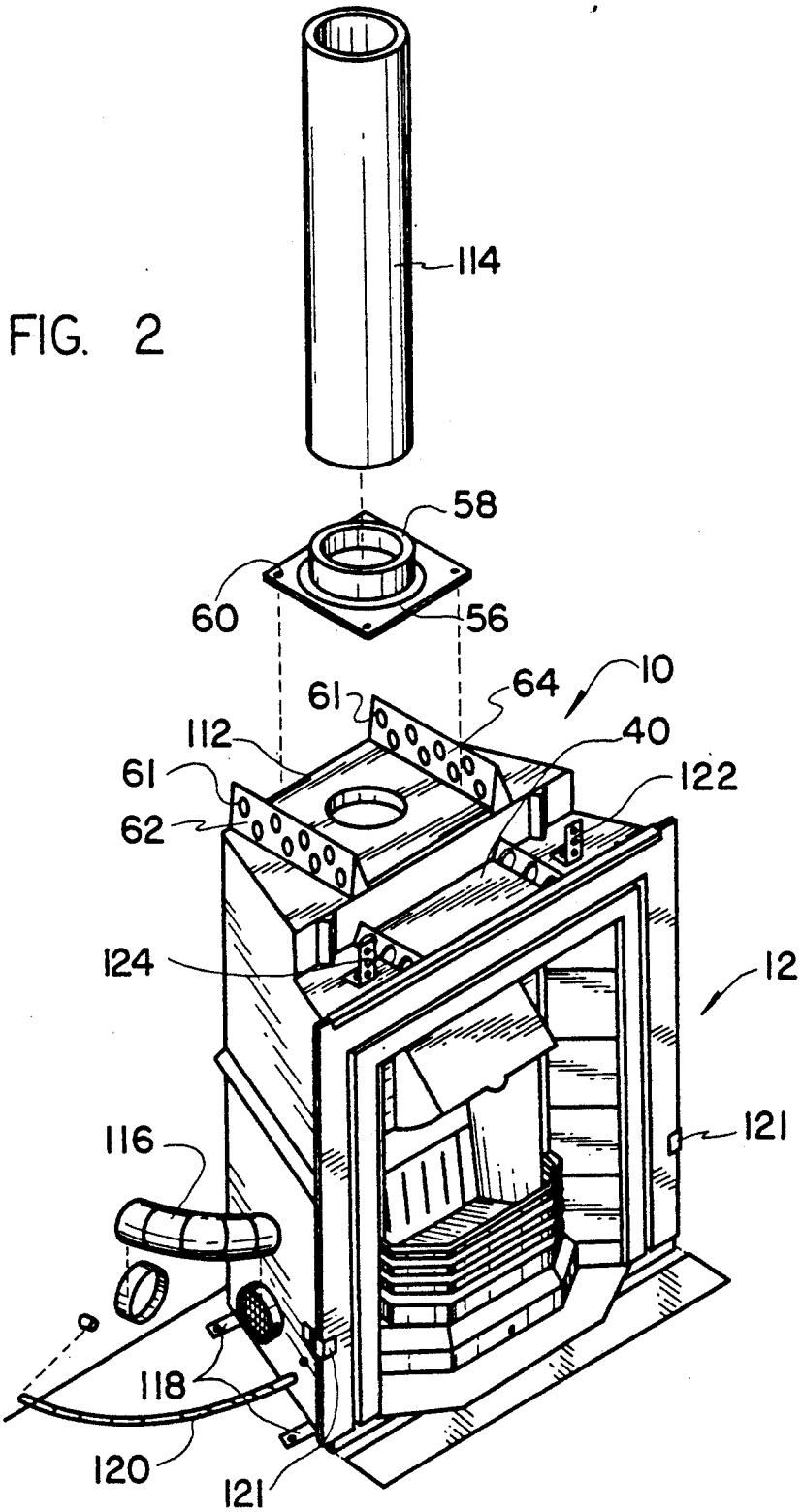
FIG. 2 is is an exploded view in perspective showing the fireplace in the installed position relative to the heat shield, and in exploded relation, the chimney system, the anchor plate, and the heat shield chimney support.

One of the lateral sidewalls 16 and 20 is provided near its lower marginal edge 22 with an aperture 24 and a collar 26 adapted to receive an air duct (not shown in FIG. 1, see FIG. 2). A flapper valve, (not shown) may be used to control outside air flow, if desired. Where the fireplace is to be used with natural gas or propane gas, an opening 28 may be provided to admit a gas inlet line, (not shown).

Each of the outer sidewalls 16, 18 and 20 is provided with a sheet metal spacer bar, e.g., spacer bar 30, located intermediate the top and bottom marginal edges of the sidewalls 16, 18 and 20, e.g., at or near the center of the sidewalls, e.g., as shown on sidewall 16, and extending in a generally horizontal direction from front to back on the lateral sidewalls, and across the back sidewall. These spacer bars, e.g., spacer bar 30, restrict the proximity of the heat shield 10 to flammable building structure, e.g., wooden studs. These spacer bars may be from about 0.75" to 3" high, for example, 1" high relative to the sidewall to which they are attached. As indicated, these spacer bars, e.g., spacer bar 30, may desirably be formed of sheet metal folded to form a triangular or inverted V-shape member, and the free marginal edges secured, as by welding, to the respective sidewalls.

The top marginal edges 32 and 34 of the opposing sidewalls 16, 16*a*, 20 and 20*a* are stepped to provide a recess 36 in the top marginal edges 32 and 36. A first trapezoidally shaped top member 38 is provided for the top step, and a second trapezoidally shaped top member 40 is provided for the lower step. A rectangularly shaped front member 42 is provided covering the step riser. The members 38, 40 and 42 are desirably welded into a single top unit with marginal orthogonally related flanges for riveting to the outer side members 16, 18 and 20. The front member 42 is welded to the front edge 44 of the top member 38, and to the rear edge 46 of the top member 40.

The top member 38 is provided with an aperture 48 adapted to receive and retain a commercially available chimney system (not shown). The upperside of the top member 38 is fitted with a chimney base pad 50, desirably a mineral fiber pad, and having an elbow 52 attached thereto for attachment to an oval-to-round adapter 54 described further below. FIG. 2 shows a commercially available anchor plate 56 having a circular collar 58 attached thereto. The anchor plate 58 has sheet metal screw holes, e.g., screw hole 60, at each corner to facilitate fastening the chimney system anchor plate 56 to the chimney base pad 50 and to the heat shield 10.

The top member 38 is provided with parallel triangularly shaped spacers 62 and 64 which also serve to strengthen the top member 38 to enable it to support the chimney system (not shown in FIG. 1). Spacers 62 and 64 are desirably parallel and extend between the parallel rear and front marginal edges of the trapezoidally shaped top member 38. These spacers 62 and 64 also desirably have holes 61 through the sides to minimize heat conduction from the heat shield 10 to any contacting frame members. The front plate 42 is also desirably provided with spaced vertically extending spacers also triangularly or inverted V-shaped sheet metal, also desirably perforated, to ensure that any contacting wooden header member is maintained at a safe distance from the heat shield 10. The second trapezoidally shaped top member 40 is also provided with spaced spacers 68 for the same purpose. Not all the spacers are required to be in contact with building structure in any one installation. The full complement of spacers provides flexibility as to installation by accommodating many different structural situations.

The heat shield 10 is also conveniently provided with a top railing 70 suitably secured, e.g., with sheet metal screws to the top member 40 for tightly holding the top marginal edge 72 of the cast iron fireplace surround 74 against gap sealing strips 76, 78 and 80. The front marginal edge 71 of the railing 70 is overfolded into a U-shape, the outer leg of which is spaced from the cast iron surround 74 to minimize heat transfer to a decorative wooden mantle, not shown, which may be superimposed over a part of the surround 74. Self-adhesive fiberglass gap sealing strips 76, 78, and 80 are suitably secured to the open front marginal edges of the heat shield 10 and serve as insulators against heat transfer to the metallic fireplace surround 74. The design of the top rail 70 and the side mounting brackets 121 serve to space a decorative wooden mantel away from the hot fireplace assembly 12.

Figure 3:
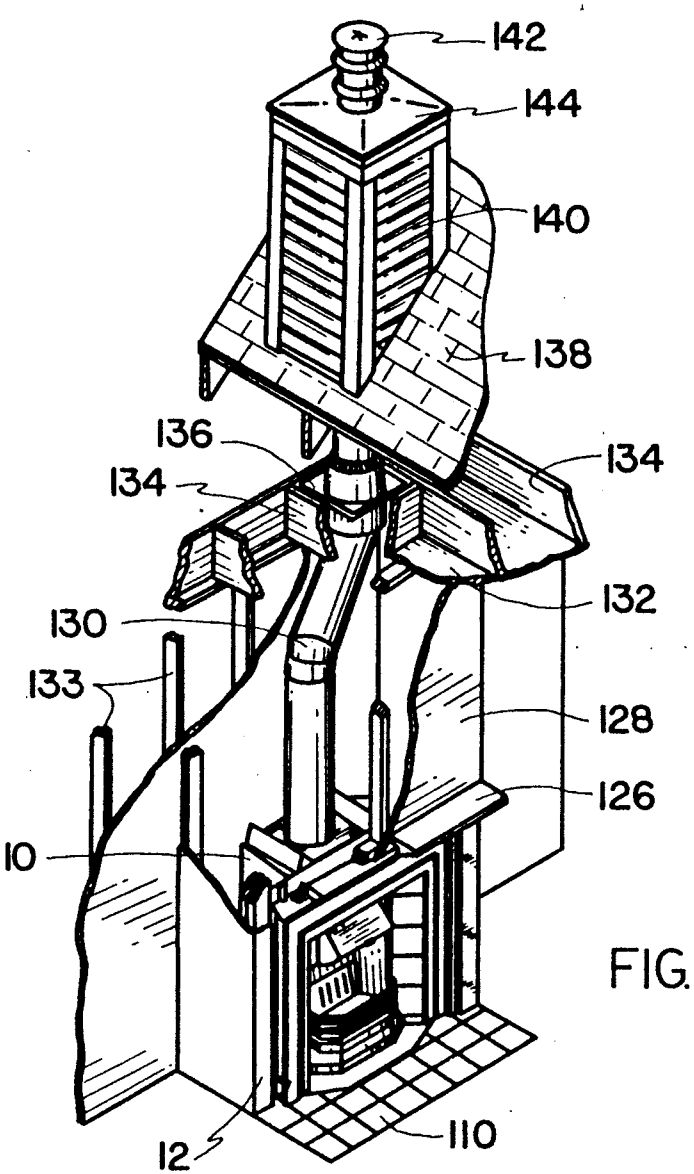
FIG. 3 is a partially cut-away view in perspective showing the fireplace, the heat shield, and the chimney system for an interior installation.
Figure 5:
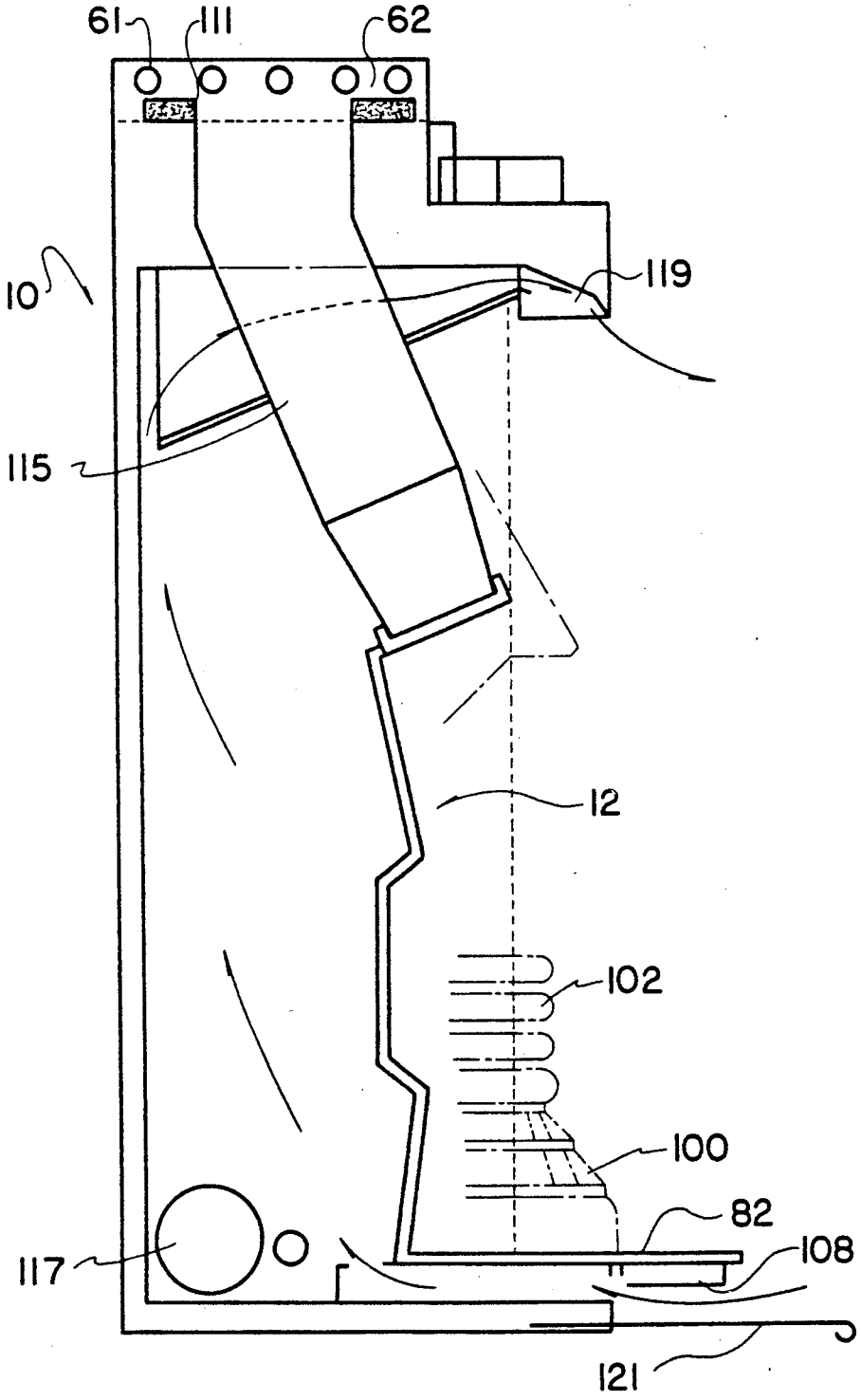
FIG. 5 is a diagrammatic cross-sectional view showing a system for collecting heat from the back of the fireplace insert with room air and optionally outside air, and recirculating the warmed air back into the room.

With further reference to FIG. 1, there is provided a pedestal 82, desirably formed of 0.25" sheet steel or alternatively, cast iron, and seated on welded 1" square steel tube members 84 and 86 to provide an underlying air gap for admission of air from the room. The pedestal 82, which is conveniently of hexagonal shape, supports the fireplace assembly 12, catches ash from a coal or wood fire and, in a sense, serves as a "bib.". As shown in FIG. 5, air from the room and from the air vent 117 (FIG. 2) may be guided behind the fireplace insert or assembly 12 to abstract heat from the region behind the fireplace assembly 12 and conduct warmed air into the room through a vent 119. The fireplace assembly 12 includes a cast iron surround 74, a recessed back 88, a floral hood 90, optionally flared tile supporting walls 92 and 94 for holding 6×6 decorative tiles, a bottom grate 96, an ash pan 98, an ash pan cover 100, and a front grate 102. The reverse side of the fireplace insert 12 includes a damper support 104 having an oval adapter 105 and a damper 106. There is also provided a hearth extension safety strip 108 which is conveniently a rectangular strip of sheet metal adapted to bridge any gap between the floor and a composition or tile hearth extension 110 (FIG. 3).

Except for the top railing 70 and the pedestal 82, the fireplace assembly or insert 12 does not touch the enclosure 10 directly thereby minimizing heat transfer to the cast iron fireplace surround 74.

FIG. 2 shows the fireplace and the heat shield fully assembled, and the lower end of the chimney system in exploded relation. There is shown an anchor plate 56 adapted to be seated on a metal surface 112 and secured thereto by suitable fastening means, e.g., sheet metal screws extending through holes 60. The anchor plate 56 is provided with a collar 58 adapted to receive and retain the lower end 114 of a standard metal chimney system. The lower end of the chimney system 114 may be seated on a metal surface 112 and in turn on a mineral fiber insulating pad 111 (FIG. 1) to limit undue heat transfer to the top of the safety enclosure or heat shield 10.

FIG. 2, also shows an air duct 116 for conducting air to the fire box of the fireplace 12. L-shaped anchoring straps 118 are provided to aid in fastening the heat shield 10 to the floor. An optional gas line 120 may be supplied if the fireplace is to be used with natural or bottled gas. Anchoring straps 122 and 124 may be secured to the second trapezoidally shaped top member 40 to aid in securing the RCS to wall framing header members.

FIG. 3 shows in partially cut-away perspective view, a fireplace 12 installed with the heat shield 10 in a framed enclosure 128. The chimney system, generally indicated at 130, is shown passing through a ceiling 132 between joists, e.g., 134 and including a firestop and joist radiation shield 136. The chimney system 130 extends through the roof 138, a chimney chase 140 and is capped with a top 142 and a storm collar 144. FIG. 3 shows a typical interior installation.

Figure 4:
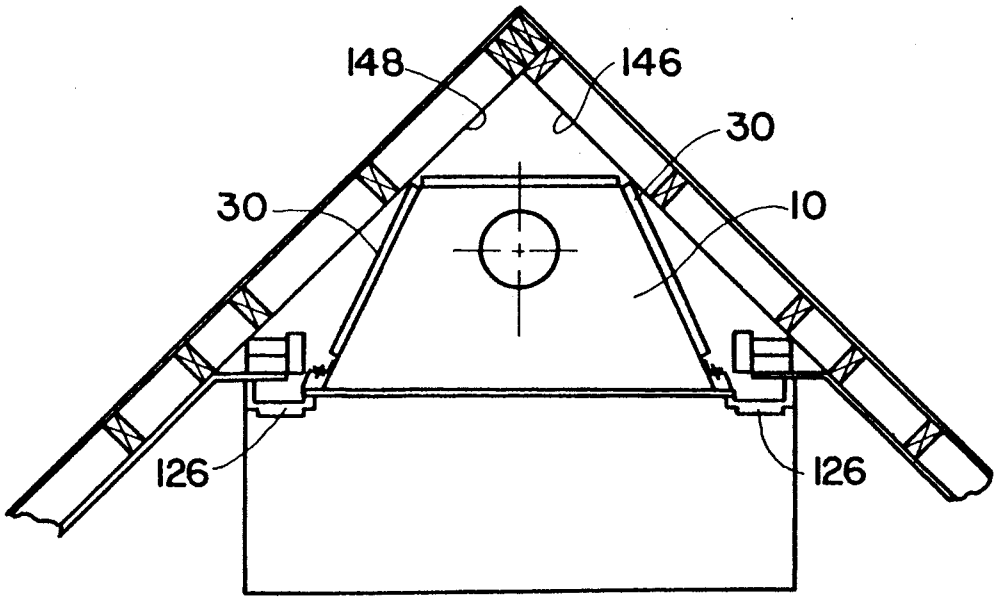
FIG. 4 is a top plan view of a portion of a frame building corner and heat shield-fireplace assembly located therein.

FIG. 4 is a cross-sectional view of a typical corner installation showing how the spacers 30 (FIG. 1) are used to limit the extension of the heat shield 10 toward the corner walls 146 and 148. The maximum allowable temperature at the points of juncture of the spacers 30 with the walls 146 and 148 is, as indicated above, no more than 170 degrees F.

FIG. 5 shows a fireplace assembly 12 in cross-section and inserted in a framed wall, and illustrating the flow of recirculating room air beneath the fireplace assembly 12 and pedestal 82, behind the insert 12 around a metal chimney 115, and a baffle 113 and through an upper vent 119 into the room. The air gap beneath the pedestal 82 keeps the floor from becoming too hot.

There has thus been provided a heat shield 10 or reduced clearance system for limiting the proximity of an installed fireplace 12 to flammable building materials, e.g., studs 133 (FIG. 3) or sheet rock nailed thereto. In the absence of such a heat shield, the minimum distances required for such a fireplace installation would be much greater to the point of impracticality.

What is claimed is:

1. A reduced clearance system for a cast iron fireplace including a surround having a rectangular outer periphery, said system including a sheet metal box at least partially open at the front, having a trapezoidally shaped sheet metal base and sheet metal side walls vertically extending from each of the three shorter sides of the base, one of the side walls including near the bottom thereof an air inlet aperture, each of the three side walls having a generally horizontal outwardly projecting sheet metal spacer bar secured thereto for limiting the clearance of the system from adjacent building structure, the opposing side walls being stepped at the top to provide a recess in the top marginal edge, a first trapezoidally shaped top member for the higher step having an aperture therein adapted to accept a flue member, a pair of spaced spacer members secured to said first top member and extending in a direction normal to the front of said box, a second trapezoidally shaped top member for the lower step, a rectangularly shaped front member covering the riser portion of the step, the second trapezoidally shaped top member having at least a pair of spaced sheet metal spacer bars extending generally normal to the front member secured thereto, the front member also having spaced generally vertically extending sheet metal spacer bars secured thereto, and a pedestal supported in spaced relation to the sheet metal base for supporting the cast iron fireplace.

2. A reduced clearance system in accordance with claim 1 wherein the sheet metal is aluminized stainless steel.

3. A reduced clearance system in accordance with claim 1 wherein the sidewalls are double sheet metal sidewalls separated by fibrous insulation.

4. A reduced clearance system in accordance with claim 1 further including sheet metal reinforcing members extending across the first trapezoidally shaped top member.

5. A reduced clearance system in accordance with claim 1 further including an anchor plate for a chimney system, said anchor plate including a collar adapted to fit into the aperture in the first trapezoidally shaped top member.

6. A reduced clearance system in accordance with claim 5 wherein the first trapezoidally shaped includes an apertured chimney base plate centrally thereof as a seat for said anchor plate.

7. A reduced clearance system in accordance with claim 6 wherein the aperture in the base plate forms a tight collar for the chimney.

8. A reduced clearance system in accordance with claim 1 further including means along the front marginal edge of the second trapezoidally shaped top member for engaging and holding the top marginal edge of said cast iron fireplace surround.

9. A reduced clearance system for a cast iron fireplace including a rectangularly shaped surround, said system including a sheet metal box at least partially open on one side thereof, and having a base, and sheet metal side walls vertically extending from each of three adjacent sides, one of said side walls including near the bottom thereof an air inlet aperture, each of the three side walls having a generally horizontal outwardly projecting sheet metal spacer bar secured thereto for limiting the clearance of the system from adjacent building structure, the opposing side walls being stepped at the top to provide a recess in the top marginal edge, a first top member for the higher step having an aperture therein adapted to accept a flue member, a pair of spaced spacer members secured to said top member and extending in a direction generally normal to the front of the box, a second top member for the lower step, a front member covering the riser portion of the step, the second top member having secured thereto at least a pair of spaced sheet metal spacer bars extending generally normal to the front member, and the front member having secured thereto spaced, generally vertically extending sheet metal spacer bars, and a pedestal supported in spaced relation to the sheet metal base for supporting the cast iron fireplace.

10. A reduced clearance system in accordance with claim 9 wherein the sidewalls are double sheet metal sidewalls separated by fibrous insulation.

11. A reduced clearance system in accordance with claim 9 which is further characterized by means along the front marginal edge of the second top member for engaging and holding the system to the top marginal edge of said cast iron fireplace surround.

12. A reduced clearance system in accordance with claim 9 in which the flue member is seated on a collar comprising a sheet metal plate and a mineral fiber insulating pad.

* * * * *

UNITED STATES PATENT AND TRADEMARK OFFICE

CERTIFICATE OF CORRECTION

PATENT NO. : 5,009,220

DATED : Apr. 23, 1991

INVENTOR(S) : Peter B. Cornelison, Hiram, Ohio

It is certified that error appears in the above-identified patent and that said Letters Patent is hereby corrected as shown below:

On the title page, item:

[75] Inventors: Peter B. Cornelison, Hiram, Ohio; Walter J. Moberg, Jr., Portland, Oregon

Signed and Sealed this

Twenty-second Day of September, 1992

*Attest:*

DOUGLAS B. COMER

*Attesting Officer*

*Acting Commissioner of Patents and Trademarks*